US011180991B2

(12) United States Patent
Haro

(10) Patent No.: US 11,180,991 B2
(45) Date of Patent: Nov. 23, 2021

(54) HAMMERLESS CUTTING BIT RETENTION SYSTEM

(71) Applicant: Caterpillar Paving Products Inc., Brooklyn Park, MN (US)

(72) Inventor: Jason A. Haro, Dayton, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/816,558

(22) Filed: Mar. 12, 2020

(65) Prior Publication Data

US 2021/0283802 A1 Sep. 16, 2021

(51) Int. Cl.

| | |
|---|---|
| ***E21C 35/197*** | (2006.01) |
| ***E21C 35/19*** | (2006.01) |
| *E01C 23/088* | (2006.01) |
| *B28D 1/18* | (2006.01) |
| *E01C 19/20* | (2006.01) |

(52) U.S. Cl.

CPC ..... *E21C 35/19* (2013.01); *E21C 35/191* (2020.05); *E21C 35/197* (2013.01); *B28D 1/188* (2013.01); *E01C 19/2025* (2013.01); *E01C 23/088* (2013.01)

(58) Field of Classification Search

CPC ..... E21C 35/191; E21C 35/1933; E21C 35/1936; E21C 35/18; E21C 35/188; E21C 35/19; E21C 33/193; E21C 35/197; E21C 35/193; B28D 1/186; B28D 1/188; E02F 9/2866; E02F 9/28; E02F 9/2808; E02F 9/2816; E02F 9/2825; E02F 9/2833; E02F 9/2841; E02F 9/285; E02F 9/2858; E01C 19/2025; E01C 23/088

See application file for complete search history.

(56) References Cited

U.S. PATENT DOCUMENTS

| | | | | |
|---|---|---|---|---|
| 5,067,775 | A | 11/1991 | D'Angelo | |
| 6,176,552 | B1 * | 1/2001 | Topka, Jr. | E21C 35/18 299/104 |
| 6,708,431 | B2 | 3/2004 | Robinson et al. | |
| 7,178,274 | B2 | 2/2007 | Emrich | |
| 7,922,256 | B2 | 4/2011 | Kammerer et al. | |
| 9,388,553 | B2 | 7/2016 | Campomanes | |
| 9,850,641 | B2 | 12/2017 | Hughes | |
| 2009/0008491 | A1 * | 1/2009 | Sharp | B02C 18/18 241/294 |
| 2012/0001475 | A1 * | 1/2012 | Dubay | E21C 35/19 299/108 |
| 2013/0169023 | A1 * | 7/2013 | Monyak | E21C 35/197 299/104 |
| 2014/0352181 | A1 * | 12/2014 | Campomanes | E02F 9/2891 37/455 |

(Continued)

FOREIGN PATENT DOCUMENTS

WO 2019105582 A1 6/2019

*Primary Examiner* — Janine M Kreck
*Assistant Examiner* — Michael A Goodwin
(74) *Attorney, Agent, or Firm* — Law Office of Kurt J. Fugman LLC

(57) ABSTRACT

A cutting bit includes a rear adapter portion having a body of revolution, an outer circumferential surface, and a first retention nub extending from the outer circumferential surface. The cutting bit also includes a forward portion, and an intermediate collar portion that is disposed between the rear adapter portion, and the forward portion.

18 Claims, 8 Drawing Sheets

(56) References Cited

U.S. PATENT DOCUMENTS

| | | | | |
|---|---|---|---|---|
| 2015/0033596 | A1* | 2/2015 | Kunz | E02F 9/2858 37/455 |
| 2017/0328037 | A1 | 11/2017 | Serrurier et al. | |
| 2018/0223661 | A1* | 8/2018 | Arnold | E21C 35/19 |

* cited by examiner

HAMMERLESS CUTTING BIT RETENTION SYSTEM

TECHNICAL FIELD

The present disclosure relates to tool adapters and retention systems used to attach tools such as cutting bits to rotary tools such as cutting drums used in milling machines, e.g. a cold planer, and the like. Specifically, the present disclosure relates to a hammerless cutting bit retention system, which may ease disassembly of the cutting bit from the cutting drum, or ease assembly of the cutting bit to the cutting drum.

BACKGROUND

Rotary tools such as cutting drums are routinely employed by milling machines such as cold planers and the like for ripping up a work surface such as soil, loose rock, asphalt, pavement, concrete, etc. As can be imagined, these rotary tools may use cutting bits adapted to perform the necessary work. These cutting bits are subject to wear. Therefore, it is often necessary to replace these cutting bits once worn. Alternatively, it may be desirable to change out one type of cutting bit for another type of cutting bit depending on the work material. For example, one cutting bit may be well adapted for ripping up concrete while another may be better suited for ripping up asphalt.

For these reasons, tool adapters (also referred to as tool holders) have been developed so that cutting bits may be changed without needing to replace the entire cutting drum. Often, the cutting bits are pressed in the tool holders, then retained with a press fit and/or a threaded fastener. Once the parts are worn out, they need to be replaced by hammering them out, or using a pneumatic or hydraulic tool.

For example, U.S. Pat. No. 5,067,775 discloses a retainer for rotatably retaining a mining tool or a wear resistant sleeve in a support block. It includes a removable collar consisting of at least two semi-annular members each having a flange extending from its inside diameter and a groove disposed about its outside diameter. The removable collar is circumferentially mountable about a rearward portion of either the mining tool or the wear resistant sleeve extending from the support block when mounted therein. The extending rearward portion has a groove circumferentially disposed therein. When the semi-annular members are mated thereabout, the flange of each member cooperates with the groove in the rearward portion of either the mining tool or the wear resistant sleeve. The groove about each semi-annular member defines in combination a substantially continuous groove about the collar. A snap ring is removably mounted in the substantially continuous groove about the removable collar.

However this known retention system as well as other known retention systems may not be as robust and easily assembled/disassembled as desired. Therefore, further improvement in these retention systems are needed.

SUMMARY

A retention system according to an embodiment of the present disclosure may comprise a base and a tool adapter. The base may include a retention portion that defines a first locking mechanism receiving cavity, a tool adapter receiving cavity, and a first retention nub receiving groove that is in communication with the first locking mechanism receiving cavity, and the tool adapter receiving cavity. The base may also include a mounting portion comprising a bottom attachment surface that is spaced away from the first locking mechanism receiving cavity and the tool adapter receiving cavity. The tool adapter may include a surface of revolution, and a first retention nub extending from the surface of revolution that is configured to slide within the first retention nub receiving groove of the base.

A cutting bit according to an embodiment of the present disclosure may include a rear adapter portion having a body of revolution, an outer circumferential surface, and a first retention nub extending from the outer circumferential surface. The cutting bit may also include a forward portion, and an intermediate collar portion that is disposed between the rear adapter portion, and the forward portion.

A base according to an embodiment of the present disclosure may comprise a retention portion that defines a first locking mechanism receiving cavity, an adapter portion receiving cavity, and a first retention nub receiving groove that is in communication with the first locking mechanism receiving cavity, and the adapter portion receiving cavity. So, the retention portion may be hollow. The base may also include a mounting portion comprising a bottom attachment surface that is spaced away from the first locking mechanism receiving cavity and the adapter portion receiving cavity. The mounting portion may be solid.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
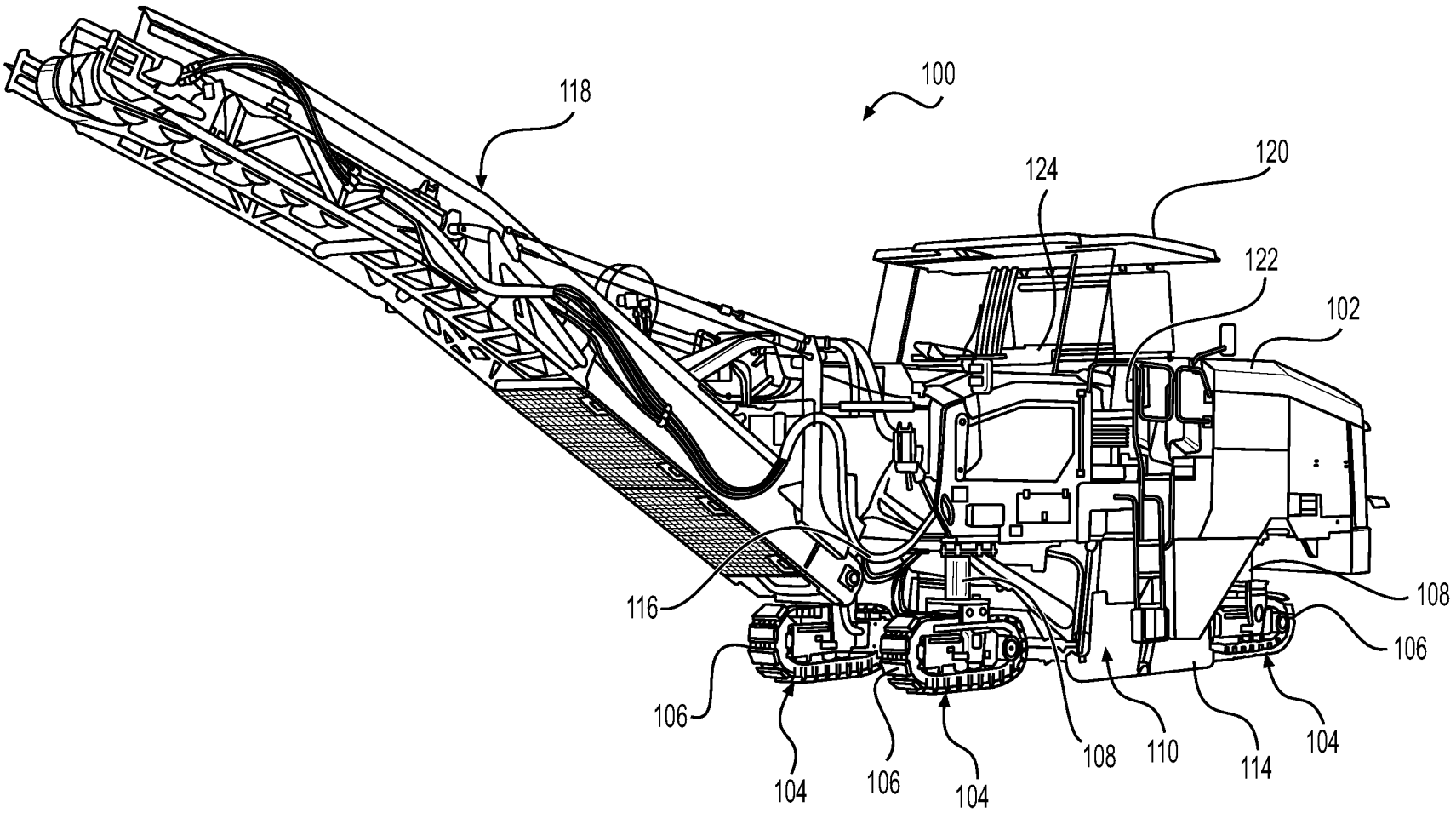
FIG. 1 is a perspective view of a machine that may use a hammerless cutting bit retention system according to an embodiment of the present disclosure for attaching a tool such as a cutting tool bit to a rotary cutting drum assembly.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or by a prime for example, 100', 100"

etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

Various embodiments of an apparatus and a method will be described herein regarding a cutting tool assembly (may also be referred to as a retention system), a base or holder, and a cutting tool for attachment to a rotary cutting drum assembly or the like.

In some embodiments, the retention system may allow for easier replacement of cutting tools without needing a hammer. In some embodiments, a ¾ ratchet may be employed.

FIG. 1 illustrates an exemplary machine 100 having multiple systems and components that cooperate to accomplish a task. Machine 100 may embody a mobile machine that performs some type of operation associated with an industry such as mining, construction, farming or agriculture, transportation, earth moving, or any other known industry. For example, machine 100 may be a milling machine such as a cold planer. Machine 100 may include a power source 102 and one or more undercarriage assembly 104, which may be driven by power source 102.

Power source 102 may drive the undercarriage assembly(s) 104 of machine 100 at a range of output speeds and torques. Power source 102 may be an engine such as, for example, a diesel engine, a gasoline engine, a gaseous fuel-powered engine, or any other suitable engine. Power source 102 may also be a non-combustion source of power such as, for example, a fuel cell, a power storage device, or any other source of power known in the art.

Undercarriage assembly(s) 104 may include crawler tracks 106. The undercarriage assemblies 104 may be attached to the machine 100 via hydraulic cylinders 108 that may be raised or lowered or rotated to position the machine 100 both vertically or horizontally at a desired position relative to a work surface. Other types of undercarriages may be employed such as those employing wheels, walking mechanisms, etc.

An implement assembly 110, which includes a rotary cutting drum assembly 112 (best seen in FIG. 2), is shown to be attached to and extend from the bottom of the machine 100 in FIG. 1 such that it can hover a desired distance above the work surface. The implement assembly 110 includes two hydraulic side plates 114 (only one of which is shown in FIG. 1 but it is to be understood that a similar side plate is on the opposite side of the machine) with position sensors (not shown) used to monitor and position the rotary cutting drum assembly 112 (shown in FIG. 2). A cover plate (not shown in FIG. 1 or FIG. 2) extending between the side plates 114 is often employed to partially surround the rotary cutting drum assembly 112, being positioned above and to the rear of the cutting drum. A transmission (not shown in FIG. 1) may be operatively connected to the power source 102 and the rotary cutting drum assembly 112, allowing the power source 102 to drive the rotary cutting drum assembly 112 to rotate and rip up the work surface.

As shown in FIG. 1, the implement assembly 110 is fitted with hydraulic hoses 116 to feed water that is sprayed onto the rotary cutting drum assembly 112, helping to remove debris from the rotary cutting drum assembly 112 in use. This debris is diverted by the machine 100 to a foldable conveyor system 118 that transports the material to another vehicle or dump site where the discarded material is hauled away from the work area.

A cab 120 is also shown that houses a seat 122 and controls 124 for the operator to use to control the various functions of the machine 100. The configuration of this machine as well as the implement assembly 110 may be varied as needed or desired. The machine of FIG. 1 is provided by way of an example only as other types of machines are considered to be within the scope of the present disclosure.

Figure 2:
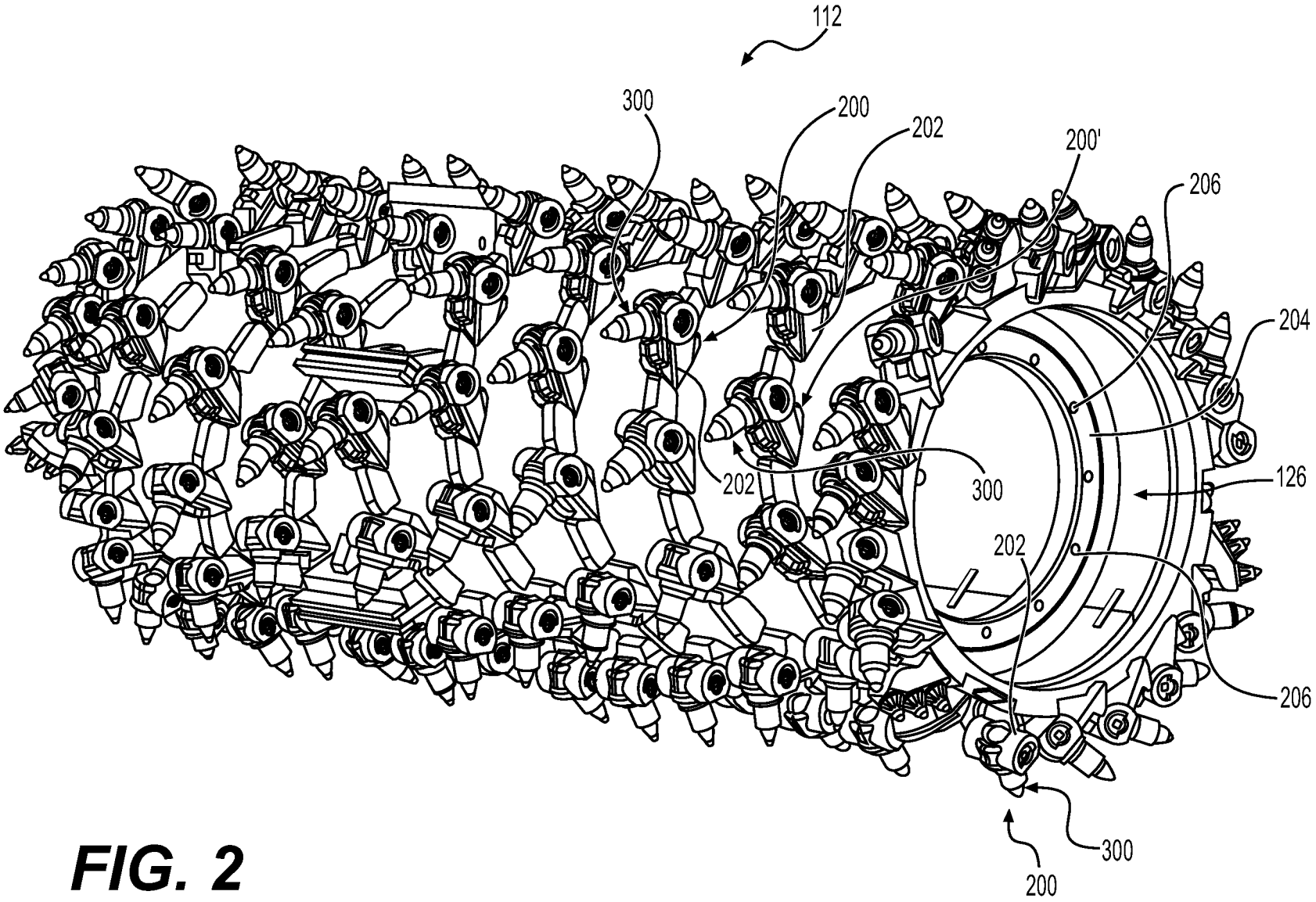
FIG. 2 is a perspective of the rotary cutting drum assembly of the machine of FIG. 1 removed from the machine illustrating a plurality of cutting tool assemblies attached to the cutting drum member.

Looking now at FIG. 2, the rotary cutting drum assembly 112 includes a substantially cylindrical drum member 126 with a plurality of cutting tool assemblies 200 attached to the drum member 126 about its circumference in a manner known in the art. For example, the cutting tool assemblies 200 may have a block or base 202, which is welded or otherwise adhered or fastened to the drum member 126. It is contemplated that the base 202 may be formed integrally with the drum member 126, having a unitary construction with the drum member 126. A series of bolt holes 206 are shown on the hub 204 of the drum member 126 that are used to attach the cutting drum member 126 to the implement assembly 110. The cutting tool assemblies 200 are shown to be attached to the cutting drum member 126 along a spiral path about the circumference of the drum member 126 with the cutting tool bit 300 of each cutting tool assembly 200 extending at a slightly different angle of attack than the adjacent cutting tool assembly 200' along the spiral path. It is contemplated that the arrangement, configuration, and angle of attack of each of the cutting tool assemblies may be varied as needed or desired.

Starting with FIGS. 3 and 4, a cutting tool assembly 200 (may also be referred to as a retention system) according to an embodiment of the present disclosure will be discussed with greater detail.

The cutting tool assembly 200 may comprise a base 202 that includes a retention portion 210 (so called since this portion retains a cutting bit and/or tool adapter, etc.) that defines a first locking mechanism receiving cavity 212, a tool adapter receiving cavity 214, and a first retention nub receiving groove 216 that is in communication with the first locking mechanism receiving cavity 212, and the tool adapter receiving cavity 214.

The base 202 may also include a mounting portion 218 (so called since this portion is used to mount the base to the hub, etc.) that comprises a bottom attachment surface 219 that is spaced away from the first locking mechanism receiving cavity 212 and the tool adapter receiving cavity 214 (or the retention portion 210 as a whole).

Figure 4:
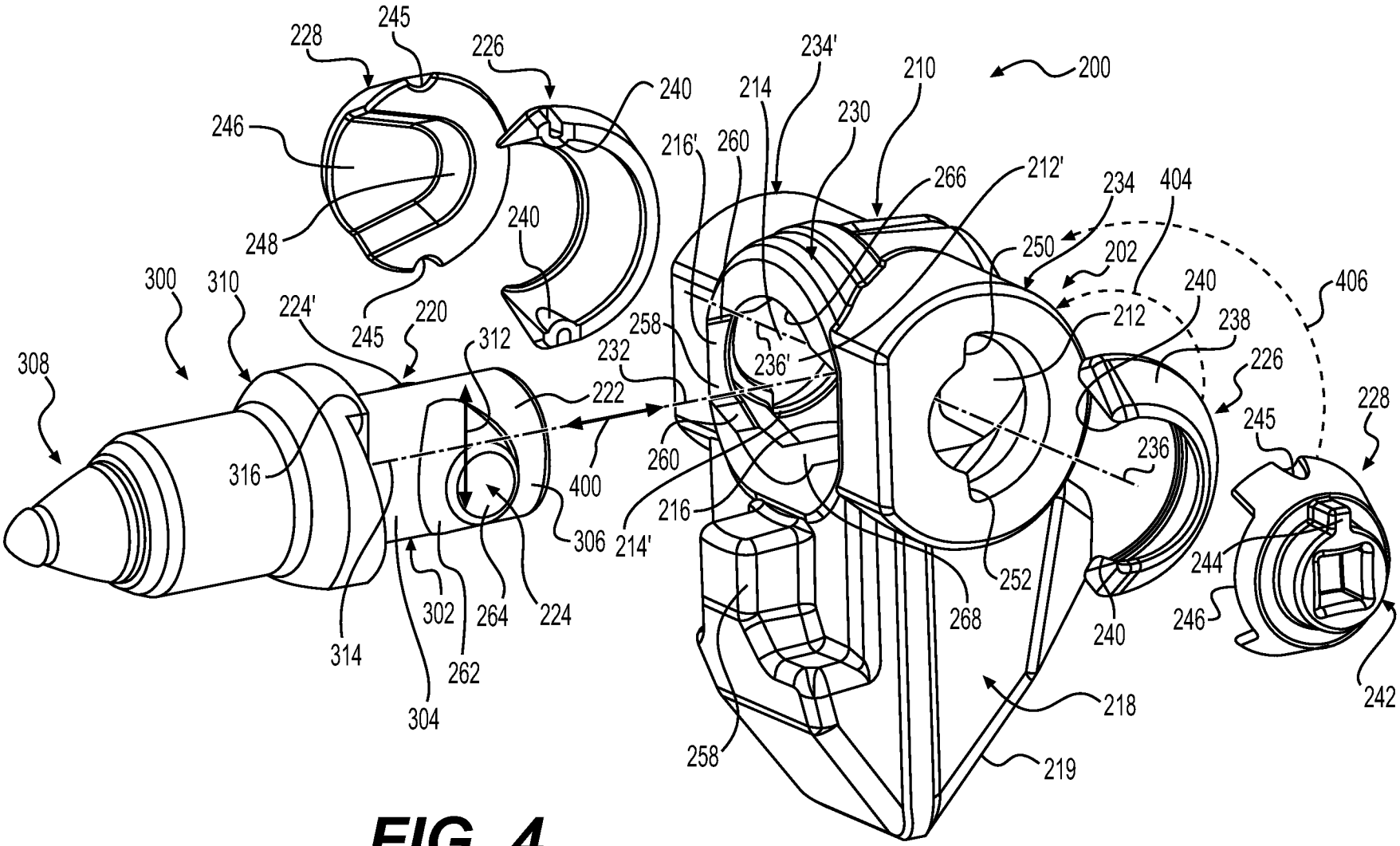
FIG. 4 is an exploded assembly view of the cutting tool assembly of FIG. 3.

As best seen in FIG. 4, the cutting tool assembly 200 may also include a tool adapter 220 (may be a tool adapter portion) including a surface of revolution 222 (e.g. cylindrical, conical, etc.), and a first retention nub 224 extending from the surface of revolution 222 that is configured to slide within the first retention nub receiving groove 216 of the base 202. For example, see the double headed arrow 400 in FIGS. 4 and 6 that represents the insertion of the tool adapter into the base or extraction of the tool adapter from the base.

Referring now to FIGS. 3, 4 and 6 thru 8, it can be seen that a first retaining sleeve 226, and a first lock retainer 228 may be disposed in the first locking mechanism receiving cavity 212. These components may be obtained from Caterpillar Inc. or one of its related companies, suppliers, etc. under the tradename of CAPSURE.

In FIGS. 3, 4, 6, and 7, the locking mechanism, in particular the first lock retainer 228, is in an unlocked configuration allowing the insertion or extraction of the tool adapter relative to the base. In FIG. 8, the first lock retainer 228 is in the locked configuration, preventing removal of the tool adapter from the base. Hence, the cutting tool assembly 200 is ready for use in FIG. 8. The locking and unlocking operation is represent by arrow 402 in FIG. 3, which indicates that rotating the first lock retainer 228 a predetermined amount (e.g. 180 degrees) in either the clockwise or the counterclockwise direction may achieve the desired effect.

Figure 5:
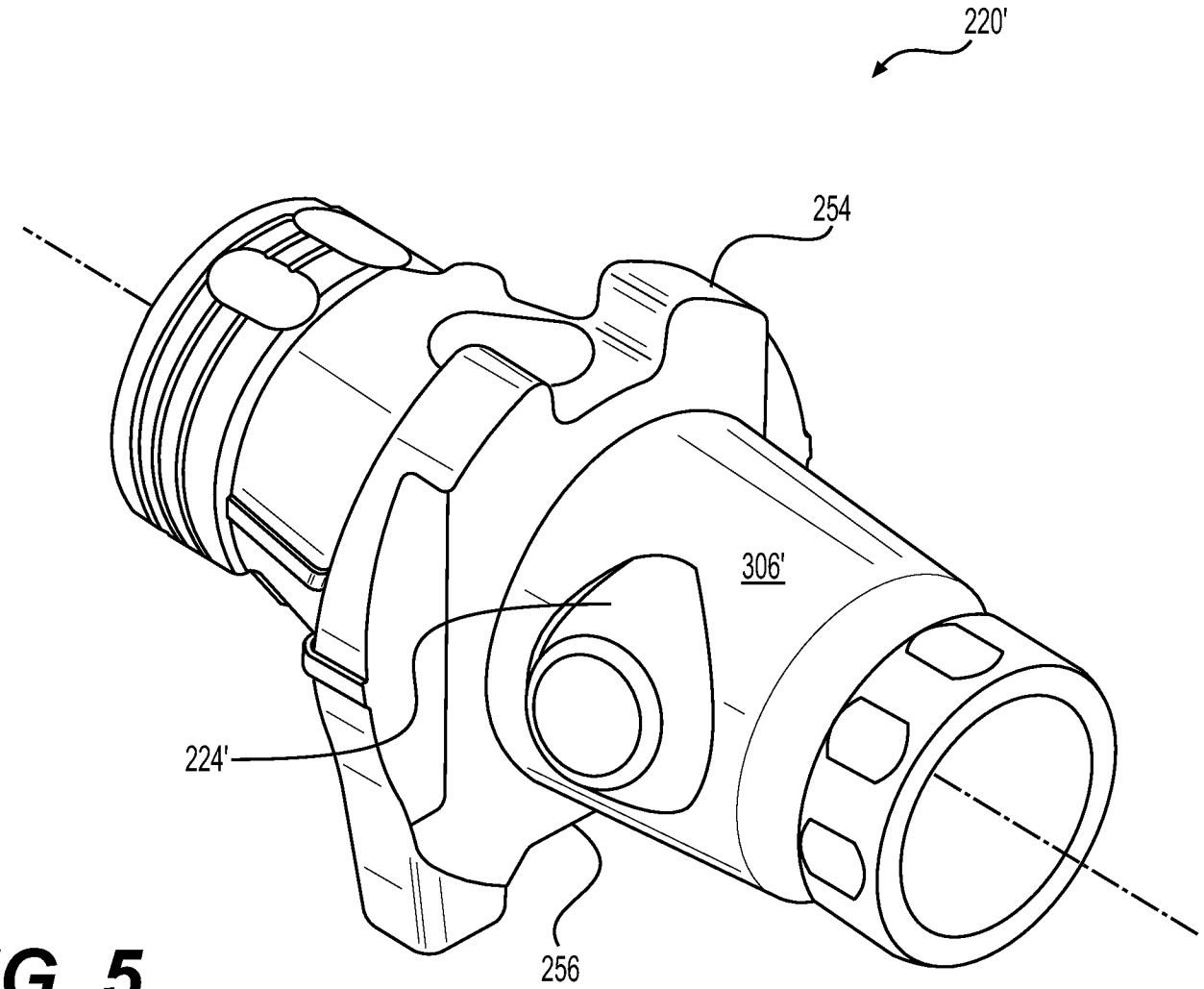
FIG. 5 is a perspective view of a tool adapter (may also be referred to as a bit holder) according to an embodiment of the present disclosure.
Figure 6:
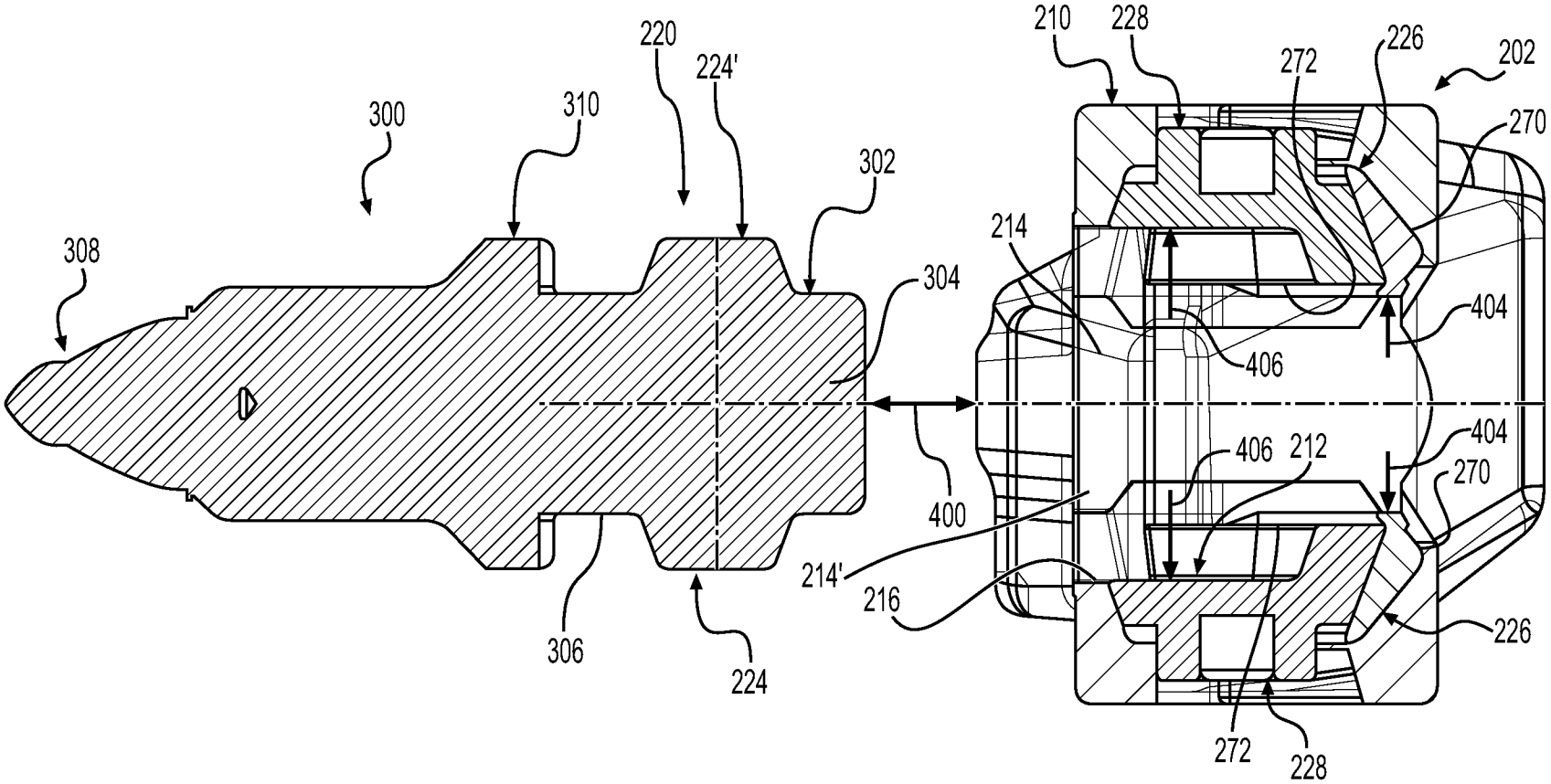
FIG. 6 is a top oriented exploded sectional view showing a tool bit with a tool adapter portion being assembled to or dissembled from holder block, to assembly or disassembly the cutting tool assembly of FIG. 3.

Looking now at FIGS. 4 and 6, it can be understood that a cutting bit 300 may be attached to the tool adapter 220. More specifically, the cutting bit 300 and the tool adapter 220 may be connected to each other as a unitary body. Alternatively, the tool adapter 220' may take the form of a separate body such as shown in FIG. 5 that may be attached to the base 202 using a first retention nub 224' as just previously described herein. In such a case, the cutting bit may be attached to the tool adapter 220' using known methods as previously described herein in the background section such as using a press fit, a spring loaded shank, a snap ring, etc., or, another set of locking mechanisms and retention nubs may be employed according to various embodiments of the present disclosure, etc.

In FIG. 5, it can be appreciated that the flange 254 of the tool adapter 220' defines a keyway 256 that mates with a key 258 (see FIG. 4) on the base 202, helping to prevent rotation of the tool adapter 220' [300] once attached to the base 202. This may not be the case for other embodiments of the present disclosure.

Focusing on FIG. 4, the retention portion 210 of the base 202 may further comprise a first annular portion 230 that defines the tool adapter receiving cavity 214, and may also define a first longitudinal axis 232 that is centered along a direction perpendicular to the first longitudinal axis 232 with respect to the mounting portion 218 of the base 202, forming an "i" shape with the mounting portion when viewed along the first longitudinal axis 232.

Moreover, the retention portion 210 of the base 202 may further comprise a first annular ear portion 234 that defines a first orthogonal longitudinal axis 236 that perpendicularly intersects the first longitudinal axis of the first annular portion 232. This first annular ear portion 234 may also define the first locking mechanism receiving cavity 212 mentioned previously herein.

Likewise, the retention portion 210 of the base 202 may further comprise a second annular ear portion 234' that defines a second orthogonal longitudinal axis 236' that is collinear with the first orthogonal longitudinal axis 236. The second annular ear portion 234' may define a second locking mechanism receiving cavity 212', and a second retention nub receiving groove 216' that is in communication with the second locking mechanism receiving cavity 212', and the tool adapter receiving cavity 214.

These various features may be identical when rotated 180 degrees about the first longitudinal axis 232 but not necessarily so. In some embodiments, the retention portion 210, and the mounting portion 218 of the base 202 may form a "T" shape or a "t" shape with respect to each other when viewed along the first longitudinal axis 232 due to the ear portions.

Furthermore, FIG. 4 illustrates that a second retaining sleeve 226 and a second lock retainer 228 may be disposed in the second locking mechanism receiving cavity 212'. The first and second lock retainers as well as the first and second retaining sleeves may be similarly or identically configured as each other but not necessarily so.

Either of the retainer sleeves may be made from a resilient material such as polyurethane and includes a partially annular configuration (e.g. extending circumferentially approximately 180 degrees) including an outer peripheral surface 238 with at least one detent rib 240 extending from the outer peripheral surface 238. Also, either lock retainer may be made from a rigid material such as steel, iron, grey-cast iron, cast iron, etc. and may include a tool engaging portion 242 (may have a socket for receiving a tool) including a stop portion 244 (may also be referred to as a tab), and a locking portion 244 including a nub receiving slot 246 and a catch surface 248. The lock retainer may also have detent groove(s) for mating with the detent rib of the retaining sleeve to hold the lock retainer in a locked or unlocked condition. The first locking mechanism receiving cavity 212 may be delimited by a first abutment surface 250, and a second abutment surface 252 that are spaced 180 degrees from each other about the first orthogonal longitudinal axis 236.

Figure 3:
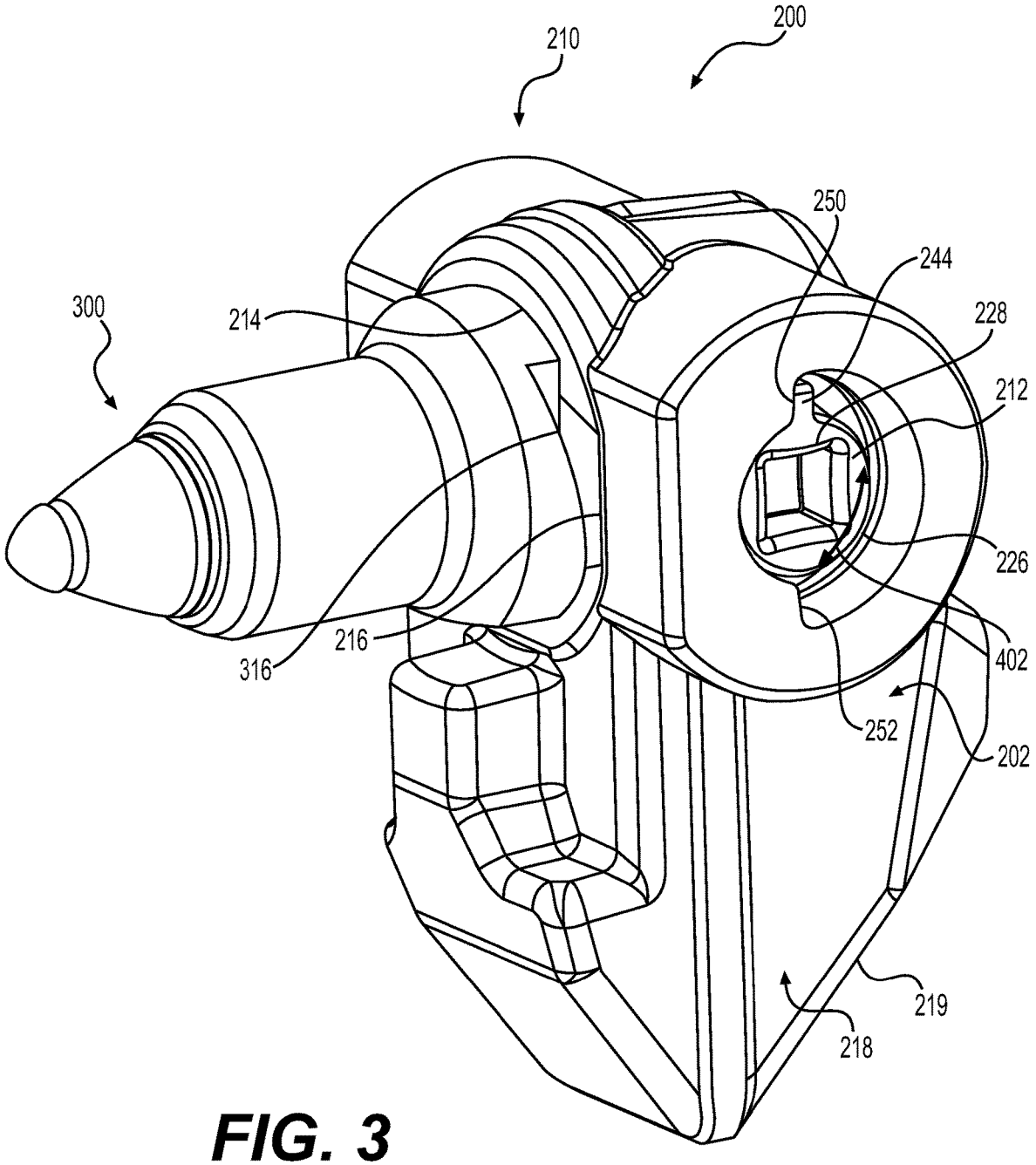
FIG. 3 is a perspective view of a cutting tool assembly removed from the rotary cutting drum assembly of FIG. 2.

In the assembled condition in FIG. 3, it can be understood that the stop portion 244 rotates from one abutment surface 250 to the other abutment surface 252 when locking or unlocking the locking mechanism. When locked as seen in FIG. 8, the catch surface 248 blocks movement of a retention nub 224 and the extraction of a tool adapter/cutting bit.

A cutting bit 300 that may be provided as a replacement part according to an embodiment of the present disclosure will now be discussed starting with reference to FIGS. 4, and 6 thru 8.

The cutting bit 300 may comprise a rear adapter portion 302 including a body of revolution 304 (i.e. a body formed by rotating geometry about an axis, e.g. a cylindrical body, a conical body, etc.) with an outer circumferential surface 306, and a first retention nub 224 that extends from the outer circumferential surface 306. Also, the cutting bit 300 may a forward working portion 308 (so called since this portion has a working edge or working feature such as a point that performs work on a work material, etc.), and an intermediate collar portion 310 that is disposed between the rear adapter portion 302, and the forward working portion 308.

In some embodiments, the outer circumferential surface 306 is a cylindrical surface (e.g. see FIG. 4). In other embodiments, the outer circumferential surface 306' is a conical surface (e.g. see FIG. 5). Other configurations for these surfaces are possible in other embodiments of the present disclosure.

As alluded to herein, the forward working portion, the intermediate collar portion, and the rear adapter portion may be joined together as a unitary piece of material (see FIGS. 4, and 6 thru 8), or may be split into an assembly of separate components such as when the tool adapter of FIG. 5 is employed, etc. When split into separate components, the forward working portion may be referred to as a "forward portion" until a cutting edge or a cutting feature such as a point is added, etc. For example, the flange 254 in FIG. 5 may be considered the intermediate collar portion, the circumferential surface 306' may be part of the rear adapter portion, and the forward portion may be designed to hold a cutting bit as discussed previously herein.

In FIG. 4, the body of revolution 304 may define a radial direction 312, and a cylindrical axis 314. The intermediate collar portion 310 may define a pry slot 316 that is disposed axially forward of the first retention nub 224 that may be used to ease remove of the cutting bit 300 from the base 202 (see also FIG. 3).

Figure 7:
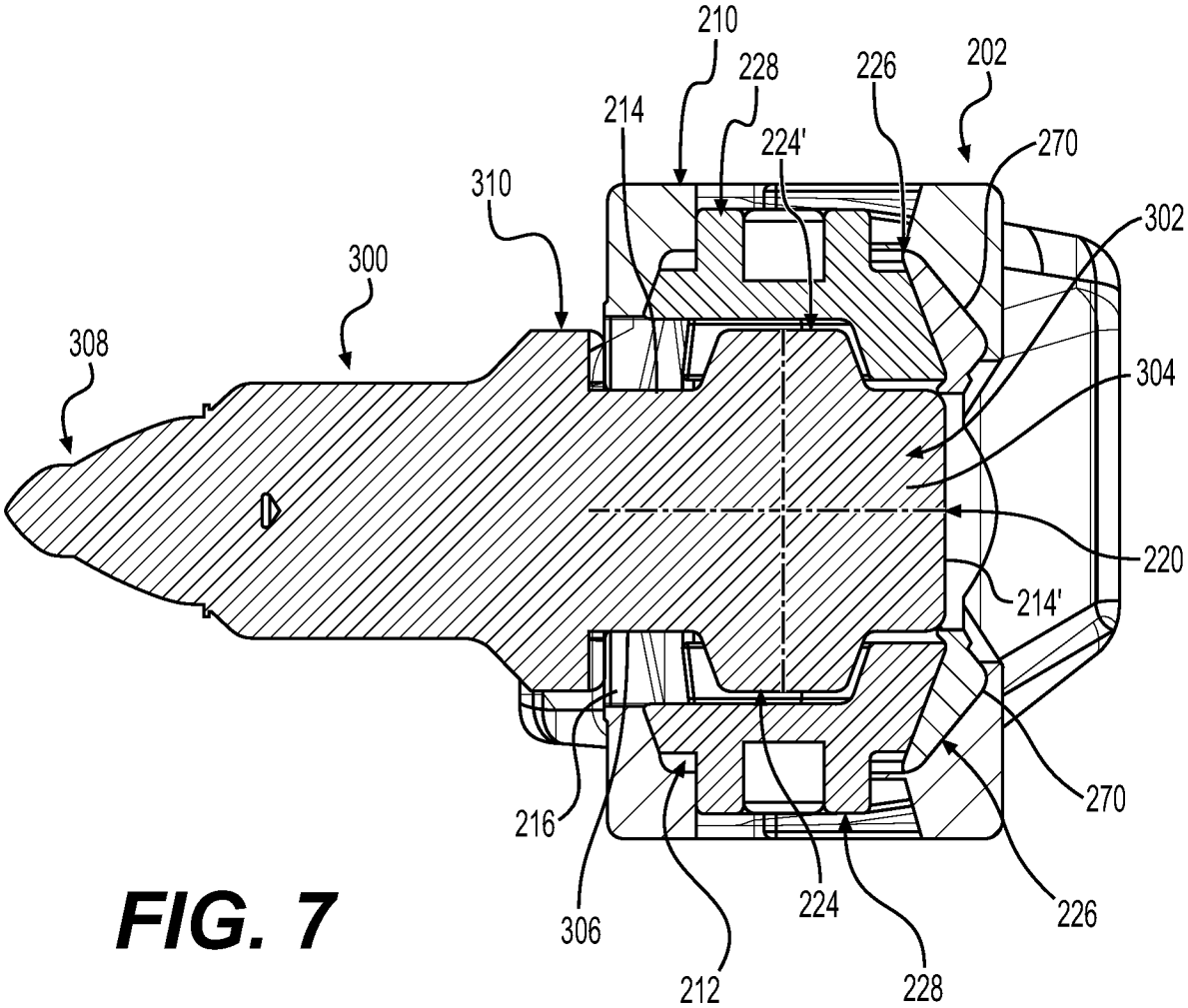
FIG. 7 illustrates the tool bit seated into the retention system contained in the holder block of FIG. 6. The retention system is shown in the unlocked configuration.
Figure 8:
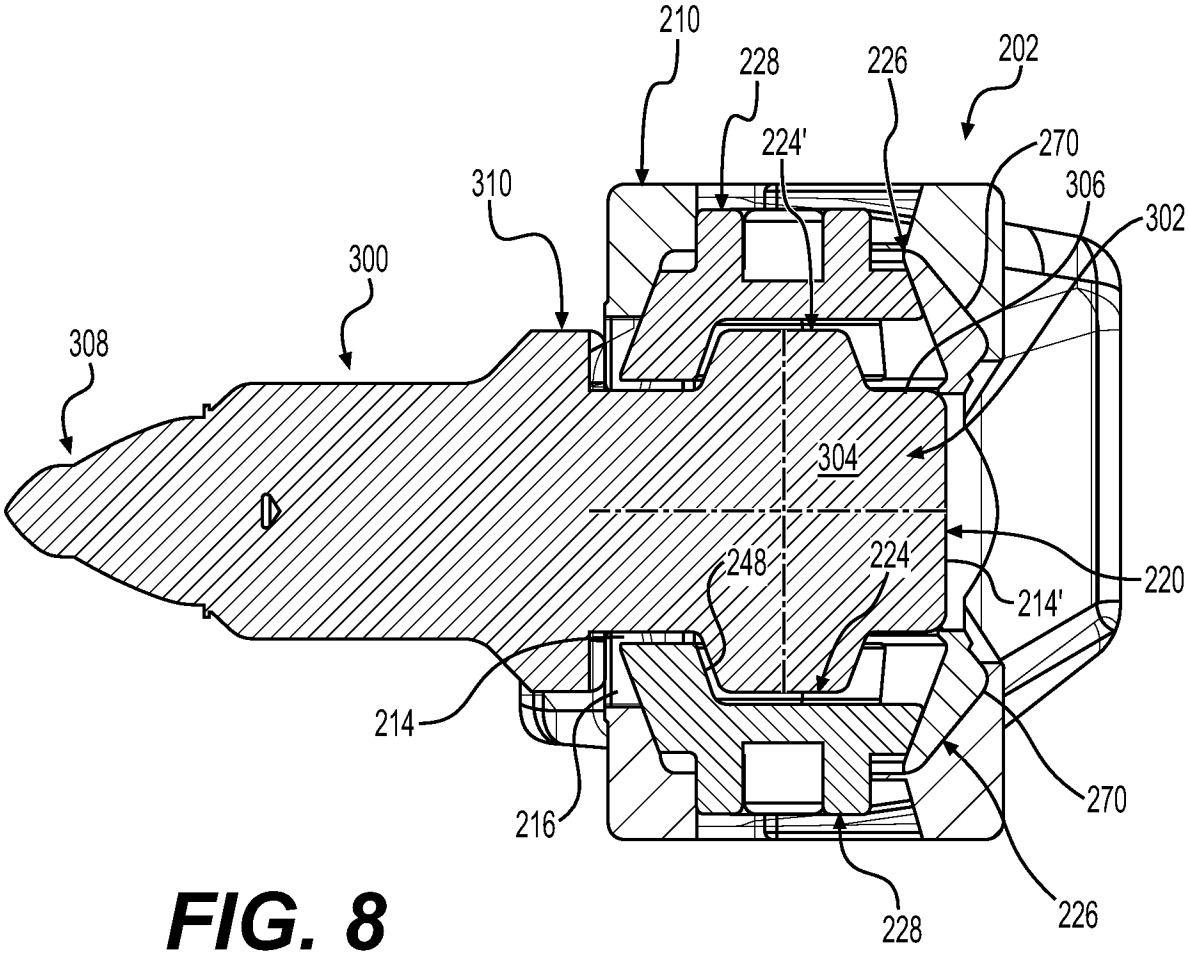
FIG. 8 shows the retention system of FIG. 7 in the locked configuration.

In addition, the rear adapter portion 302 may further a second retention nub 224' (see FIGS. 4, and 6 thru 8) that extends from outer circumferential surface 306 and that is axially aligned with the first retention nub 224, facing in the radial direction 312 in an opposite manner as compared to the first retention nub 224 such that the rear adapter portion 302 defines a "t" or "+" shape when viewed from the top (see FIGS. 6 thru 8).

Next, a base 202 according to an embodiment of the present disclosure that may be provided as a replacement part will now be discussed starting with FIG. 4.

The base 202 may comprise a retention portion 210 that defines a first locking mechanism receiving cavity 212, an adapter portion receiving cavity 214', and a first retention nub receiving groove 216 that is in communication with the first locking mechanism receiving cavity 212, and the adapter portion receiving cavity 214'. Hence, the retention portion 210 may be characterized as being hollow due to the presence of these voids.

On the other hand, the mounting portion 218 comprising a bottom attachment surface 219 (may be arcuate to match the drum) that is spaced away from the first locking mechanism receiving cavity 212, and the adapter portion receiving cavity 214'. Hence, the mounting portion 218 may be characterized as being solid to provide strength and rigidity.

In some embodiments, the adapter portion receiving cavity 214' extends completely through the retention portion 210. This may not be the case for other embodiments of the present disclosure.

Also, the retention portion 210 may define a second retention nub receiving groove 216' that is aligned with the first retention nub receiving groove 216 and is also in communication with the adapter portion receiving cavity 214', forming a "Φ" shape (on its side) with the first retention nub receiving groove 216 and the adapter portion receiving cavity 214' when viewed along the first longitudinal axis 232.

The first and the second retention nub receiving grooves 214, 214' may be identically configured being bounded by a side surface 258, and a pair of angled surfaces 260 that form obtuse angles with the side surface 258. Thus, these grooves may be similarly shaped to a retention nub that includes a conical surface 262 and end face 264. Similarly, the adapter portion receiving cavity 214' may be bounded by an upper cylindrical surface 266, and a lower cylindrical surface 268. So, these surfaces may match the cylindrical profile of the outer circumferential surface 306 of the rear adapter portion 302.

As also alluded to earlier herein, the retention portion 210 may include a first ear portion (e.g. 234) defining the first locking mechanism receiving cavity 212, and a second ear portion (e.g. 234') defining a second locking mechanism receiving cavity 212'. The first and the second ear portions may be configured such that the retention portion 210 forms a "T" shape or "t" shape with the mounting portion 218 when viewed along the first longitudinal axis 232.

It should be noted that the particulars of the cutting bit, adapter, and base as well as their construction, configuration, method of assembly, etc. are provided by way of an example only and it is contemplated that other embodiments of the present disclosure are possible.

The arrangement, function, and dimensions of the various features of any embodiment of a cutting bit, adapter, and base as discussed herein may be altered as needed or desired to be different than what has been specifically mentioned herein.

INDUSTRIAL APPLICABILITY

In practice, a tool adapter, a cutting tool assembly, a rotary cutting tool assembly, an implement assembly, a cutting bit, a locking mechanism, a base, or a machine using any of these components according to any embodiment described herein may be sold, bought, manufactured or otherwise obtained in an OEM (original equipment manufacturer) or after-market context.

Any portion of the tool adapter, cutting bit, and base may be manufactured from a rigid material such as steel, iron, grey-cast iron, cast iron, etc.

The retention system may be assembled and used as follows for attaching a cutting bit or adapter to a base. First, the base is attached to the drum as previously described herein (e.g. welded). Second, the locking mechanism(s) are assembled into the base by first compressing the resilient retaining sleeve (see arrow 404 in FIGS. 4 and 6) until it is trapped in the locking mechanism retaining cavity by an undercut 270 (see FIGS. 6 thru 8). Third, the lock retainer is placed into retaining sleeve and held in the locking mechanism retaining cavity (see arrow 406 in FIGS. 4 and 6) by a lip 272 (see FIGS. 6 thru 8). It is to be understood that these steps may be performed in different order. For example, the second and the third steps may be accomplished before the first step.

Fourth, the lock retainer is rotated into an unlocked configuration if it isn't already (see arrow 402 in FIG. 3). Then, the lock retainer is rotated into a locked configuration as shown in FIG. 8. Now, the cutting bit is ready for use. Disassembly may be achieved by reversing one or more of these steps.

If a tool bit wears down or it becomes desirable to change the tool bit for any reason, the user may rotate the lock retainer with a tool such as a ratchet as previously described herein into the unlocked configuration. Then, the tool bit may be removed with a tool such as a pry bar as previously described herein. This may provide for an easier and more robust method of assembly and disassembly than previous known methods and retention systems.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A retention system comprising:

a base including a retention portion that defines a first locking mechanism receiving cavity, a tool adapter receiving cavity, and a first retention nub receiving groove that is in communication with the first locking mechanism receiving cavity, and the tool adapter receiving cavity;

a mounting portion comprising a bottom attachment surface that is spaced away from the first locking mechanism receiving cavity and the tool adapter receiving cavity; and a tool adapter including a surface of revolution, and a first retention nub extending from the surface of revolution that is configured to slide within the first retention nub receiving groove of the base;

wherein the retention portion defines a second retention nub receiving groove that is aligned with the first retention nub receiving groove and is also in communication with the tool adapter receiving cavity, forming a "Φ" shape with the first retention nub receiving groove and the adapter portion receiving cavity.

2. The retention system of claim 1 further comprising a first retaining sleeve and a first lock retainer that are disposed in the first locking mechanism receiving cavity.

3. The retention system of claim 2 wherein the retention portion of the base further comprises a first annular portion that defines the tool adapter receiving cavity, and also defines a first longitudinal axis that is centered along a direction perpendicular to the first longitudinal axis with respect to the mounting portion of the base, the tool adapter receiving cavity of the first annular portion and the mounting portion forming an "i" shape when viewed along the first longitudinal axis.

4. The retention system of claim 3 wherein the retention portion of the base further comprises a first annular ear portion that defines a first orthogonal longitudinal axis that perpendicularly intersects the first longitudinal axis of the first annular portion, the first annular ear portion also defining the first locking mechanism receiving cavity, and a first forward facing flat face that is perpendicular to the first longitudinal axis.

5. The retention system of claim 4 wherein the retention portion of the base further comprises a second annular ear portion that defines a second orthogonal longitudinal axis that is collinear with the first orthogonal longitudinal axis, the second annular ear portion defining a second locking mechanism receiving cavity, and the second retention nub receiving groove is in communication with the second locking mechanism receiving cavity and the tool adapter receiving cavity.

6. The retention system of claim 5 wherein the retention portion and the mounting portion of the base form a "T" shape with respect to each other when viewed along the first longitudinal axis defined by the tool adapter receiving cavity.

7. The retention system of claim 5 further comprising a second retaining sleeve and a second lock retainer that are disposed in the second locking mechanism receiving cavity.

8. The retention system of claim 5 wherein the first retaining sleeve includes a partially annular configuration including an outer peripheral surface with at least one detent rib extending from the outer peripheral surface, and the first lock retainer includes a tool engaging portion including a stop portion, and a locking portion including a nub receiving slot and a catch surface, the first locking mechanism receiving cavity being delimited by a first abutment surface, and a second abutment surface that are spaced 180 degrees from each other about the first orthogonal longitudinal axis.

9. The retention system of claim 1 further comprising a cutting bit that is attached to the tool adapter.

10. The retention system of claim 9 wherein the cutting bit and the tool adapter are connected to each other as a unitary body.

11. A cutting bit comprising:

a rear adapter portion including a body of revolution defining a radial direction, and an axis, an outer circumferential surface, and a first retention nub extending from the outer circumferential surface;

a forward portion; and an intermediate collar portion disposed between the rear adapter portion, and the forward portion;

wherein the rear adapter portion further comprises a second retention nub that is aligned with the first retention nub along the axis and faces in the radial direction in an opposite manner as compared to the first retention nub such that the rear adapter portion defines a "t" shape or a "+" shape.

12. The cutting bit of claim 11 wherein the outer circumferential surface is a cylindrical surface, and the forward portion is a forward working portion.

13. The cutting bit of claim 12 wherein the forward working portion, the intermediate collar portion, and the rear adapter portion are joined together as a unitary piece of material.

14. The cutting bit of claim 12 wherein the intermediate collar portion defines a pry slot that is disposed axially forward of the first retention nub.

15. A base comprising:

a retention portion that defines a first locking mechanism receiving cavity, an adapter portion receiving cavity, and a first retention nub receiving groove that is in communication with the first locking mechanism receiving cavity, and the adapter portion receiving cavity; and a mounting portion comprising a bottom attachment surface that is spaced away from the first locking mechanism receiving cavity and the adapter portion receiving cavity;

wherein the mounting portion is solid and the retention portion is hollow, and the retention portion defines a second retention nub receiving groove that is aligned with the first retention nub receiving groove and is also in communication with the adapter portion receiving cavity, forming a "Φ" shape with the first retention nub receiving groove and the adapter portion receiving cavity.

16. The base of claim 15 wherein the adapter portion receiving cavity extends completely through the retention portion.

17. The base of claim 15 wherein the first and the second retention nub receiving grooves are identically configured being bounded by a side surface and a pair of angled surfaces that form obtuse angles with the side surface, and the adapter portion receiving cavity is bounded by an upper cylindrical surface and a lower cylindrical surface.

18. The base of claim 15 wherein the retention portion includes a first ear portion defining the first locking mechanism receiving cavity, and a second ear portion defining a second locking mechanism receiving cavity, the first and the second ear portions being configured such that the retention portion forms a "T" shape with the mounting portion, the first ear portion also defining a first planar surface that is disposed adjacent to the first retention nub receiving groove without defining any portion of the first retention nub receiving groove.

* * * * *